US007002089B2

(12) United States Patent
Stevenson

(10) Patent No.: US 7,002,089 B2
(45) Date of Patent: Feb. 21, 2006

(54) LAYERED SWITCH ASSEMBLY

(75) Inventor: Robin Stevenson, Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 24 days.

(21) Appl. No.: 10/836,795

(22) Filed: Apr. 30, 2004

(65) Prior Publication Data

US 2005/0241930 A1 Nov. 3, 2005

(51) Int. Cl.
*H01H 1/10* (2006.01)

(52) U.S. Cl. ..... 200/512; 200/312

(58) Field of Classification Search ..... 200/308–317, 200/5 A, 5 R, 6 R, 4, 6 A, 17 R, 18, 512–517, 200/329; 296/146.7, 39
See application file for complete search history.

(56) References Cited

U.S. PATENT DOCUMENTS 5,359,164 A * 10/1994 Kucharski, Jr. ..... 200/315
5,434,757 A * 7/1995 Kashiwagi ..... 362/501
5,787,167 A * 7/1998 Anderson ..... 379/446
5,952,630 A * 9/1999 Filion et al. ..... 200/5 R
6,239,392 B1 * 5/2001 Serizawa et al. ..... 200/5 R
6,483,048 B1 * 11/2002 Bontrager et al. ..... 200/5 R
6,536,825 B1 3/2003 McAndrew et al.
6,565,142 B1 5/2003 Gibney, Jr. et al.
6,750,407 B1 * 6/2004 Song et al. ..... 200/5 A
6,820,921 B1 * 11/2004 Uleski ..... 296/152
2001/0052715 A1 12/2001 McAndrew et al.
2003/0052501 A1 3/2003 Schmidt et al.
2003/0052502 A1 3/2003 Schmidt et al.
2003/0052512 A1 3/2003 Schmidt et al.
2003/0052513 A1 3/2003 Uleski
2003/0052514 A1 3/2003 Schmidt et al.
2003/0080582 A1 5/2003 Gibney, Jr. et al.

* cited by examiner

*Primary Examiner*—Elvin G. Enad
*Assistant Examiner*—Lisa Klaus
(74) *Attorney, Agent, or Firm*—Kathryn A. Marra

(57) ABSTRACT

A layered switch assembly permits more than one electric circuit function to be obtained from each of a set of switches used to control electric circuit functions such as the operation or adjustment of seats, mirrors or other components in an automotive vehicle passenger compartment. A group of switches for operator control is embedded in an armrest, console, or the like. Overlying the discrete switches are two or more flexible sheet or membrane layers for selective activation of one or more of the switches. Illuminated indicia on each switch activation layer identify the underlying switch operation. The uppermost layer controls the electrical switch function unless that layer has been moved aside to expose the next lower switch function activation layer.

11 Claims, 3 Drawing Sheets

LAYERED SWITCH ASSEMBLY

TECHNICAL FIELD

This invention pertains to assemblies of switches in which each switch activates, alternatively, two or more different electrical circuits. More specifically, this invention pertains to assemblies comprising several switches in a base with two or more overlying sheet layers for identified selection of specific switches and circuit functions, and touch activation of the switches. These compact assemblies enable an operator of a motor vehicle to adjust many different components, such as mirrors and seats, from a single switching location.

BACKGROUND OF THE INVENTION

Electrical switches and controls have been grouped at locations in passenger compartments of automotive vehicles for easy access by the driver. For example, switches for control of a radio or automatic speed control have been located in a steering wheel pad. Switches for adjustment of outside mirrors, for opening windows, and for seat adjustments have been located in the operator's arm rest.

It is an object of this invention to provide an assembly of electrical switches in a base where each switch is adapted to control two or more different electric circuits. It is a further object of this invention to provide such a switch assembly with two or more sheet or membrane layers, overlying the group of switches, for touch activation of a selected switch. It is a more specific object of this invention that the overlying sheets be used to identify and control which circuit is activated by a selected switch.

It is a further object of this invention to provide means for internal illumination of the layered switch assembly.

SUMMARY OF THE INVENTION

This invention provides a layered switch assembly for operating a plurality of switches where each switch is wired or otherwise adapted to control two or more electrical circuits. A grouping of switches is located in a base portion of the assembly with two or more flexible sheet layers placed over the switch contacts for identification of specific switch functions and touch activation of a specific switch and circuit. In a preferred application, the compact switch assembly is placed near the operator of a motor vehicle for selective control of many electric circuits. Such circuits may be for actuating or controlling vehicle components such as a radio, navigation system, automatic vehicle speed control, lighting, vehicle front seat location, driver side and passenger side outside mirror positions, window openings or the like.

In accordance with a preferred embodiment of the invention, each switch is adapted to alternatively turn on two different electric circuits for vehicle components, usually passenger compartment components. The specified switches are located in a planar pattern in the armrest assembly for finger tip operation by the vehicle operator. Two flexible sheet or membrane layers, showing identified switch function activation locations, are used to select and activate a switch. A first sheet layer is fixed over the pattern of switches with the respective switch function activation symbols or indicia overlying corresponding switch contacts. A second sheet layer with a second set of switch function activation locations is placed over the first sheet, again with the second layer of identified switch activation locations overlying corresponding switches.

The upper sheet of switch function activator locations is supported over the lower sheet so that the upper sheet can be moved to uncover the lower sheet. For example, the upper sheet can be slid sideways, or fore or aft, from over the lower sheet, or it can be hinged and lifted from contact with the lower sheet. In this embodiment, the location of the upper sheet is used to determine which set of switch function activators activates a given switch and electric circuit. When the upper sheet is positioned with its switch activators overlying the set of switches, the vehicle driver can touch a location on that sheet to accomplish a desired electrically powered operation, such as opening a window. In order to accomplish an operation controlled by a lower sheet switch activator, the driver moves the upper sheet from over the lower sheet thereby exposing the lower sheet and its switch function symbols and indicia. The driver then touches the indicated switch activator on the lower sheet. Thus, for a specified number of switches and with two sheets of switch activators, up to twice the number of switching functions can be accomplished.

Thus, the location of one of the sheets, preferably the more accessible upper sheet, is used to control which of its circuits a specified switch activates. For example, when the upper sheet is juxtaposed over the lower sheet, a microswitch may be activated by an edge of the upper sheet to obtain switch functions indicated on the upper sheet. Sliding of the upper sheet from its operative position, away from contact with the microswitch, activates the switch functions designated on the lower sheet.

The switches that are part of this layered assembly are those that can be activated by touch on a flexible sheet, fabric or membrane activation layer. Such switches may directly control a specified function such as brake pedal location, seat positioning or the like. However, many of such operations are motor driven and require relatively high current electrical circuits. Accordingly, it may be preferred to use the subject layered switch assembly to operate a lower current, control circuit that in turn manages higher power vehicle functions.

The switch activator locations on the various layers of this switch assembly need to be visible to the vehicle operator, and there will be times when ambient light is inadequate and the assembly must be illuminated by vehicle lighting. The assembly may be illuminated from above its location in the arm rest or the like. Alternatively, a light source may be provided at the switch assembly and its light dispersed through transparent portions of the sheet layer controls so that switch function indicia on the control sheets can be seen by the operator of the vehicle.

Other objects and advantages of the invention will become more apparent from a detailed description of preferred embodiments which follow.

DESCRIPTION OF PREFERRED EMBODIMENTS

Modern automotive vehicles use many electric circuit switches for control of components in the vehicle. Mechanical switches typically function by bringing together or separating two or more metal contacts to open or close an electric circuit. Such switches are made in many different sizes, shapes and forms and often contain a depressible plunger or button, or a toggle, to open and close the metal contacts of the switch. In automobiles switches are often located on an armrest or console or instrument panel in the passenger compartment.

Other switches are located, for example, in a soft steering wheel pad with a flexible surface layer of synthetic plastic material. These switches, sometimes called membrane switches, are also touch activated. They usually comprise one or more sets of stationery contact points on a stiff base. An upper membrane with a flexible conductive material on the lower side is separated by a spacer from the stationery contacts. Depressing the membrane touches the conductive material to the contacts to close a circuit. When the switch is released, the flexible membrane returns to its original position and breaks contact. This invention can be practiced with any of such described mechanical or membrane switches and with any switch adapted for location in a passenger compartment location within reach and touch by the vehicle operator or other passenger.

Figure 1:
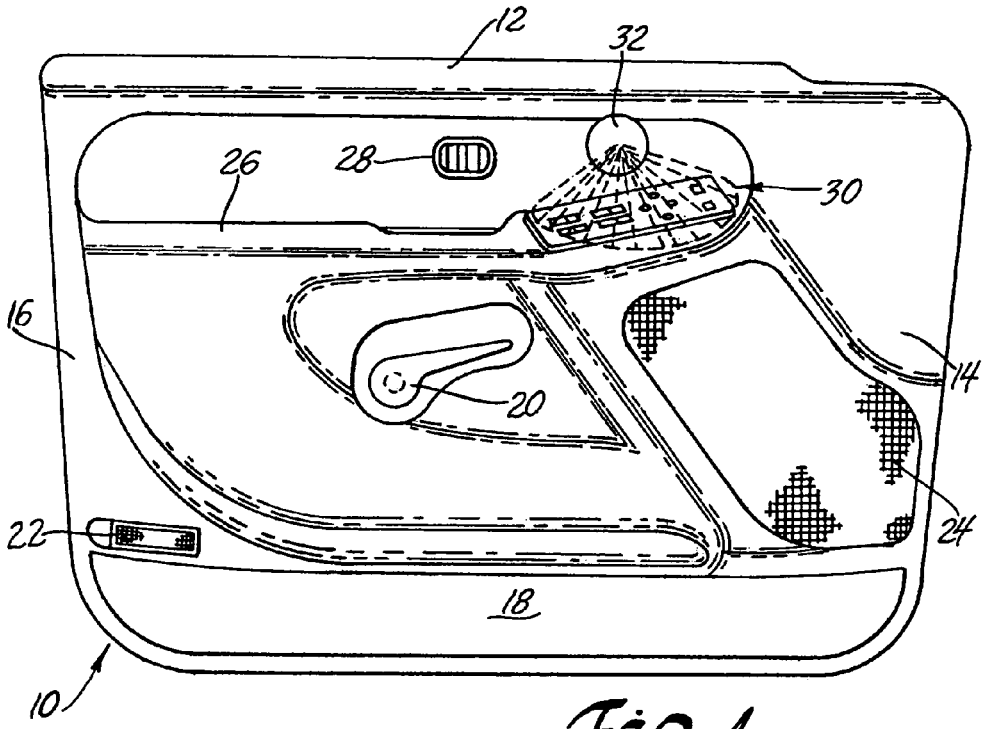
FIG. 1 is an elevation view of trim panel on a driver-side door of a motor vehicle. The trim panel includes an arm rest which carries an embodiment of a layered switch assembly of this invention.

In accordance with a preferred embodiment of the invention, a layered switch assembly is incorporated in an arm rest on the driver-side door. A vehicle door is an assembly typically comprising an outer sheet panel with an attached inner sheet panel. The door panel structure includes an open upper frame portion for a slidable window and a closed lower portion accommodating mechanical components for door closure and locking and for window lowering and lifting. Space between outer and inner door panels also accommodates electric wiring for facilitating door locking and window lifting and other vehicle component control functions. A decorative and functional molded plastic/fabric trim panel is suitably attached to the inner sheet metal door structure. FIG. 1 illustrates in elevation view such a trim panel for a driver-side door.

Referring to FIG. 1, driver-side door trim panel 10 includes a window sill portion 12, a forward portion 14 adjacent the door hinge, a rear portion 16 adjacent a door latch and a lower portion which in this instance contains a map pocket 18. Extending inwardly from the center of trim panel 10 is a door handle 20 for unlatching the door. Trim panel 10 also contains a courtesy light assembly 22 and a speaker enclosure 24 for the audio system of the vehicle. Molded integrally with the trim panel 10 is an arm rest 26 for the convenience and the comfort of the driver. Included in armrest 26 is a layered switch assembly 30 as a preferred embodiment of this invention. Located above arm rest 26 is a door lock-unlock switch 28 and a light 32 for illumination of the layered switch assembly 30.

Located behind door trim panel 10 in the compartment formed by the door panel members (and not visible in the drawing figures) is electric wiring for connecting to switch members that will be described in connection with switch assembly 30. The wiring connects the switches with an electric power source such as the vehicle battery and with the respective components that are adjusted or controlled by the switch elements. These wiring and electric power supply features that are used with this layered switch assembly are conventional in automotive vehicle design and manufacture.

Figure 3A:
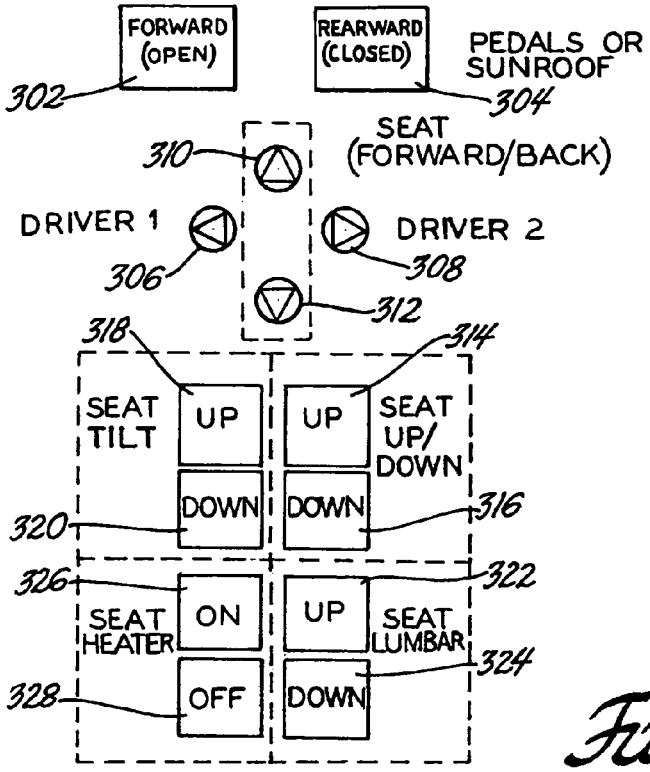
FIG. 3A is a plan view of representative indicia for first switch function activation of a set of switches in an arm rest switch assembly.

Mechanical switches currently placed in the armrest are labeled with schematic symbols, icons or other indicia of the function that is actuated by touching the switch. In accordance with this invention, switch locations on a switch activation layer are similarly labeled. FIG. 3A illustrates a series of electrically executed functions that could be undertaken by a driver before the vehicle is set in motion. By way of example, the vehicle may have a sunroof to be opened or closed by a suitable electric motor, or it may have brake and/or clutch pedals whose fore-aft position is to be controlled by operation by an electrical motor. In FIG. 3A, switch activation function 302 is used to actuate a switch to open a sunroof or to move operator pedals to a more forward position. Similarly, switch activation function 304 is used to close a sunroof or to position brake and/or clutch pedals to a more rearward position.

Another grouping of switches that are often located on the driver side armrest are those used for moving the driver seat backward or forward for one or more drivers that regularly use the vehicle. In this example, switch activation function 306 is to designate an adjustment for driver number 1 and switch activation function 308 designates a seat adjustment for driver number 2. Switch activation function 310 moves the seat forward for the driver selection and switch activation function 312 moves the seat rearwardly. For additional seat controls, switch activation functions 314 and 316 may be employed to elevate the horizontal seat portion or to lower the seat, respectively. Switch activation functions 318 and 320 may be used to tilt the seat upwardly or downwardly, respectively. Finally, in accordance with this example, switch activation functions 322 and 324 are be used to advance or retract a lumbar adjustment in the back of the seat. Switch activation functions 326 and 328 may turn a seat heater on and off, respectively.

In accordance with prior art, the switching function indicia in FIG. 3A would be printed on actual mechanical switches extending above the plain of the armrest. In accordance with a practice of this invention, these indicia are printed on sheet layers that overlie the switches which are embedded in these same locations in a switching assembly incorporated into the armrest.

Figure 3B:
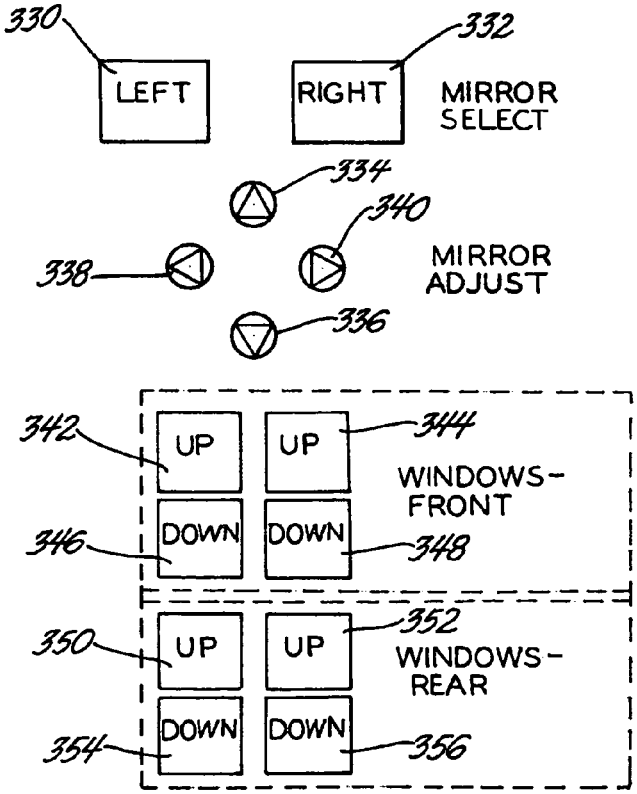
FIG. 3B is a plan view of representative indicia for second switch function activation of a set of switches in an arm rest switch assembly.

FIG. 3B illustrates switching functions which are more commonly executed after seat adjustment and sunroof adjustments have been made, possibly after the vehicle has been set in motion. For example, switching functions are provided for selecting the left mirror 330 or the right mirror 332 for adjustment for driver viewing. Mirror adjustment switching functions 334, 336, 338 and 340 have arrows indicating four directions of mirror movement. Front windows on either side of the vehicle can be raised or lowered by driver selection of UP switching functions 342 or 344, or DOWN switching functions 346 or 348. Similarly, the rear windows may be raised or lowered by driver selection of UP switching functions 350 or 352, or DOWN switching functions 354 or 356.

In accordance with this invention, it is possible and practical to use a set of switches arranged in a pattern in the armrest of a driver side door panel to perform both the switching functions illustrated in FIG. 3A and the switching functions illustrated in FIG. 3B. This will be illustrated with reference to both FIG. 1 and FIG. 2.

Figure 2:
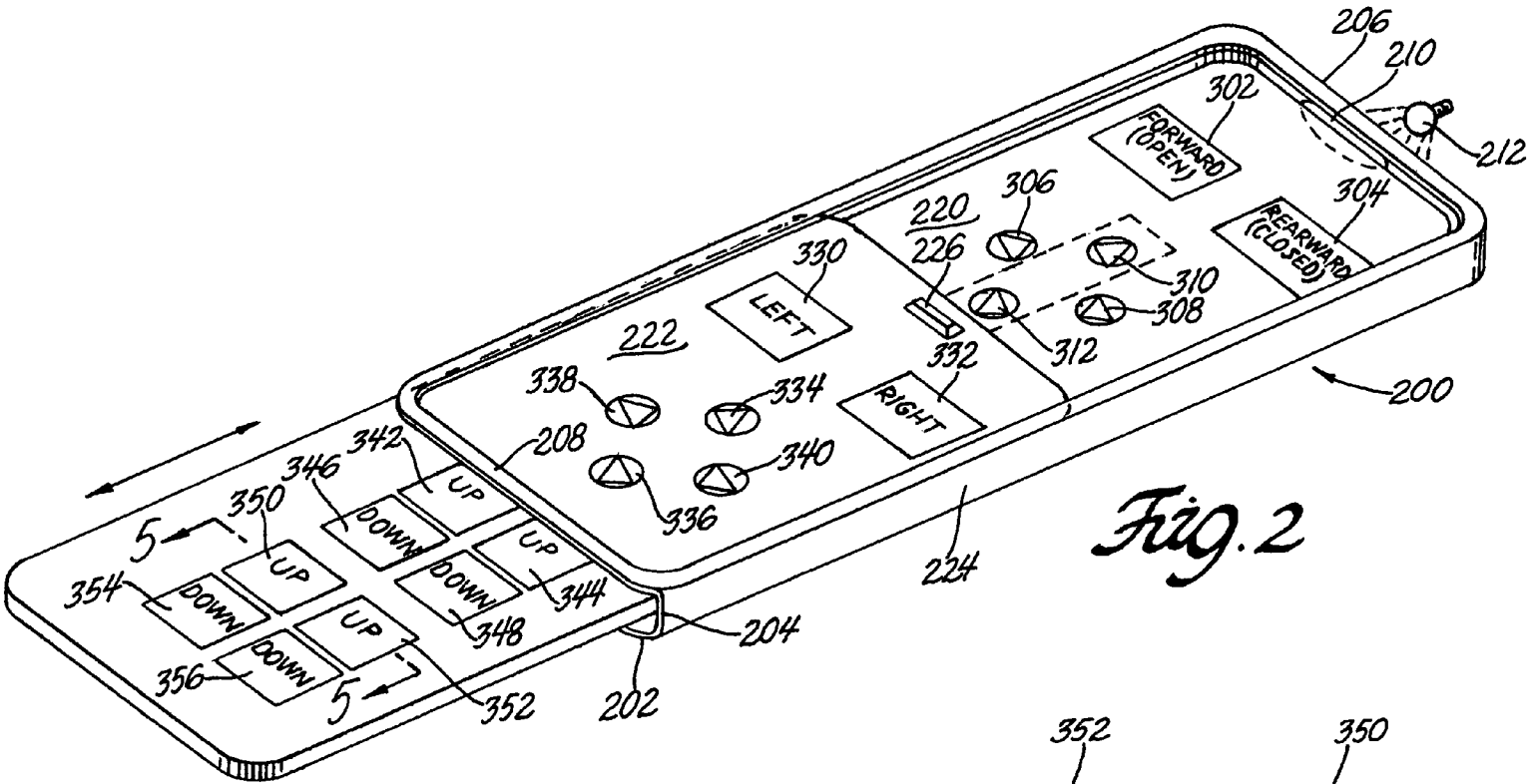
FIG. 2 is a perspective view of an assembly of two switch function activation layers in a frame for placement, for example, in an armrest of a driver side door inner trim panel.

In accordance with the invention, a specified number of switches are placed in the assembly 30 in armrest 26. The switches are arranged in a pattern underneath the common switch activation function indicia illustrated in FIGS. 3A and 3B. The switch activation portion 200 of a switch assembly is shown in FIG. 2. Assembly 200 includes a lower switch function activation layer 220 and an upper switch function layer 222. Switch function layers 220, 222 are secured in a bracket 224 having a lower portion 202 for holding switch function layer 220 in a fixed position and an upper layer 204 for holding switch function layer 222 so that it can be moved or slid by the driver in a fore-aft direction. Bracket 224 has a closed end 206 at the front end of switch assembly 30 and a rearward open end 208 which permits the vehicle operator to grasp tab 226 and slide upper switch function activator 222 forward or backward in bracket 224 to cover or expose the upper surface of lower switch activation layer 220. When upper switch activator 222 is temporarily moved rearward, a major portion of its length may be permitted to slide under a covering layer of the armrest (not shown in FIG. 1) out of the driver's way.

In FIG. 2, switch activation functions of lower switch activation layer 220 are labeled as these functions are illustrated and identified in FIG. 3A. Likewise, switch activation functions of the upper switch function layer 222 are labeled as the functions are illustrated and identified in FIG. 3B. Thus, in this embodiment, lower switch activation function layer 220 is fixed in bracket 224 and upper switch activation function layer 222 is moved by the operator fore or aft in bracket 224 to cover or expose lower switch activation layer 220. At the front end 206 of bracket 224 is a microswitch 210. When upper switch activation function layer 222 is moved forward and engages microswitch 210, the second layer identified switch functions (as illustrated in FIG. 3B) are in affect. When upper switch activation function layer 222 is moved away from microswitch 210 then the switch functions (FIG. 3A) indicated on the lower switch activation function layer 220 are actuated.

Figure 4:
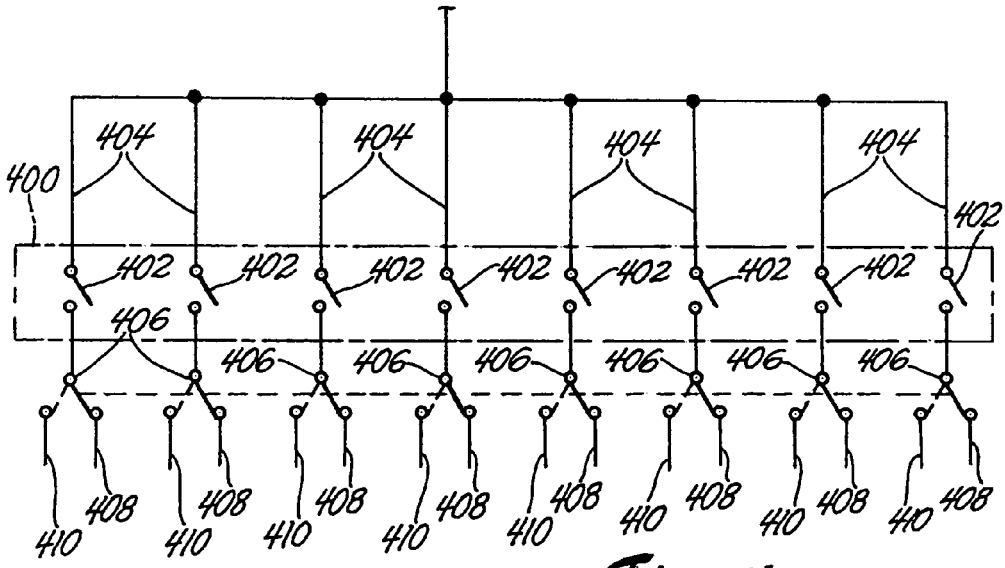
FIG. 4 is a simplified schematic circuit diagram for a set of switches and an activation function control microswitch for a layered switch assembly of this invention.

FIG. 4 is a schematic wiring diagram of eight switches arranged in a straight line pattern as indicated in the dashed line bracket 400. The switches 402 are schematically illustrated as being identical mechanical two-pole, i.e. two-contact surface, switches. But the switches may be of any type suitable for use in the various circuits that are controlled by the switch assembly. The switches will be suitably embedded in a base layer of assembly 30 with electrical leads connecting them in the respective electrical circuits that they are to control. One contact of each switch will be positioned for switching or activation by overlying switch function activation layers 220, 222.

Switches 402 are illustrated in FIG. 4 in a straight line arrangement for simplicity of illustration of their interconnections. In the switch assembly embodiment being described, they would be arranged in the pattern indicated in the FIGS. 3A and 3B so that the switch function indicia in both of switch function activation layers 220 and 222 would overlie a corresponding switch. The physical switches, not illustrated, are embedded in a suitable base layer of switch assembly 30 with their switch contacts positioned for activation by depression of the then-active, flexible switch function activation layer.

One contact member of each switch is connected through electrical wire leads 404 to an electrical power source, not shown, such as a vehicle battery. In FIG. 4, each switch 402 is illustrated as being in parallel electric connection to a power source, but this is not a limitation on the many ways that the switches 402 of switch assembly 30 can be connected to the various circuits that it controls.

A specific switch 402 is closed by touch on a switch function indicia on layer 220 or 222 (FIG. 2). Such activation of a switch 402 completes the selected circuit. But each switch 402 may be used to activate two or more circuits depending upon which switch function activation layer (such as layers 220, 222) is active. And in this embodiment, the functionality of a switch 402 depends on the position of the upper switch function activation layer(s), for example, the position of layer 222 in FIG. 2. When switch function activation layer 222 is fully forward in bracket 224 it engages microswitch 210. Microswitch 210 controls switching junctions 406 (FIG. 4) and whether closure of a switch 402 will power electric circuit branch 408 or 410. For example, when second switch function layer 222 engages microswitch 210 the circuit junctions at 406 are each controlled to activate circuit branches 408, the upper layer switch function branches. When upper switch activation layer 222 has been moved back from contact with microswitch 210 the circuit junctions at 406 are controlled to activate circuit branches 410, the lower switch activation layer circuit functions. Thus, the function of microswitch 210 is to activate control of the circuit paths (branches 408 or branches 410) at junctions 406.

In this illustrative example, two switch function activation layers are employed in assembly 200. However, more than two switch activation layers could be used in the subject layered switch assembly. Additional switch function activation layers would require additional microswitches, or other circuit selection devices, to execute the desired switch function.

In layered switch assembly 200 illustrated in FIG. 2, the upper switch function layer 222 is moved by sliding fore and aft. It could, of course, be moved into or out of contact with microswitch 210 in other directions or by other means. It could, for example, be slid outwardly toward the driver or it could be hinged to be lifted upwardly by the driver. In general it is preferred to locate this switch assembly at the front end of the armrest for easy finger tip control by the driver and movement of the upper switch assembly backward out of the assembly unit 200 when the driver wishes to manage a switching function controlled by lower switch activation function layer 220.

The switch function activation layers 220, 222 are made of flexible, yet durable material such as a nylon fabric or a synthetic polymer sheet material. The layers must be flexible to enable touch activation of underlying switches and they must be durable to withstand repeated sliding and touching. The switch function indicia may be printed on a surface of each switch function activation layer.

When the interior of the vehicle is dark the assembly 30 may be illuminated by interior light 32 on door panel 10. However, it may be preferred to provide internal illumination for the switch assembly. When the assembly is associated with the driver side armrest, for example, it is contemplated that the switches, their wiring connection and a portion of bracket 224 will be embedded in the armrest with the decorative surface material of the armrest surrounding bracket 224. A light 212, or light carrying fiber optic end, may be directed at an end 206 of bracket 224. In this embodiment, bracket 224 would be molded of a suitable light transparent plastic material which would carry and direct the light from source 212 around the periphery of bracket 224 and around switch function activation layers 220, 222. Layers 220, 222 would be constructed as illustrated in FIG. 5 to carry light from surrounding bracket 224 to the indicia bearing surfaces of the switch activation layers.

Figure 5:
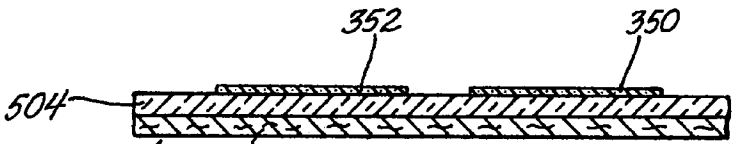
FIG. 5 is a cross-sectional view of a portion of the second switch function activation layer, taken in the direction 5—5 as indicted in FIG. 2, where the activation layer is constructed for internal illumination.

FIG. 5 is a cross-sectional view of a portion of upper switch activation layer 222 in the direction indicated at 5—5 of FIG. 4. Switch activation layer 222 is to be sufficiently flexible for touch activation of switches 402 through lower switch activation layer 220. In this embodiment, switch activation layer 222 comprises a thin durable base layer 502 adapted for sliding within bracket 224 and over lower switch activation layer 222. Base layer 502 is not necessarily transparent to visible light. However, applied to base layer 502 is a layer 504 which is transparent to light and capable of carrying light from bracket 224 to printed, or otherwise applied, switch function indicia such as 350 and 352 on the upper surface of layer 504. Window raising indicia 350 and 352 are thus lighted from below their image from light source 212 or the like. Lower switch activation layer 220 is suitably of the same light transmitting construction so that it is visible when the upper layer 222 is moved.

While the invention has been illustrated in terms of specific embodiment, it would be appreciated that other forms of the invention could readily be adapted by one skilled in the art. Accordingly, the scope of the invention is not intended to be limited by these specific examples.

What is claimed is:

1. A switch assembly for activation of a selected electric circuit from a plurality of electrical circuits, said switch assembly comprising:

a plurality of electrical switches, each switch being alternatively connectable for activation of a first electric circuit or for activation of a second electric circuit;

a first layer of sheet material overlying said switches for activating contact with said switches, said first layer having an upper surface with first layer indicia identifying a first electric circuit function of an underlying switch;

a second layer of said sheet material adapted to overlie said first layer of sheet material for activating contact with said switches, said second layer having an upper surface with second layer indicia identifying a second electric circuit function of an underlying switch, said second layer being supported for movement from a first position overlying said first layer for second electric circuit activation of one or more of said switches to a second position exposing said first layer for first electric circuit activation of one or more of said switches; and a circuit activation switch engagable by one of said first or second layers for selective connection of said electrical switches to one of said first electric circuits or said second electric circuits.

2. A switch assembly for touch activation of a selected electric circuit from a plurality of electrical circuits, said switch assembly comprising:

a plurality of electrical switches located in a pattern, each switch being alternatively connectable for activation of a first electric circuit or for activation of a second electric circuit;

a first layer of sheet material in a fixed position overlying said switches, said first layer having a lower surface for activating contact with said switches and an upper surface with first layer indicia arranged in said pattern of switches with each element of said first layer indicia identifying a first electric circuit function of an underlying switch;

a second layer of said sheet material adapted to overlie said first layer of sheet material, said second layer of sheet material having a lower surface for activating contact with said switches and an upper surface with second layer indicia also arranged in said pattern with each element of said second layer indicia identifying a second electric circuit function of an underlying switch, said second layer being supported for movement from a first position overlying said first layer for second electric circuit activation of one or more of said switches to a second position exposing said first layer for first electric circuit activation of one or more of said switches; and a circuit activation switch engagable by said second layer in its first position, for activating one of said first or second circuits when said second layer is in its first position and then activating the other circuit when said second layer is in its second position out of contact with said circuit activation switch.

3. A switch assembly as recited in claim 2 which is adapted for touch activation by a driver in the passenger compartment of a motor vehicle.

4. A switch assembly as recited in claim 3 which is adapted for assembly in an armrest in the driver side door of said vehicle.

5. A switch assembly as recited in claim 2 in which said pattern of switches and said first and second sheet material layers are rectangular in plan view, and said second sheet layer is supported at two opposing side edges for sliding in said support between said first and second positions.

6. A switch assembly as recited in claim 2 in which at least one of said layers is made of a woven fabric and said indicia are printed on the upper surface of said fabric.

7. A switch assembly as recited in claim 2 in which at least one of said layers is made of a polymeric sheet material and said indicia are printed on the upper surface of said polymeric sheet material.

8. A switch assembly as recited in claim 2 in which the indicia on said first and second layers are illuminated by light directed into the edges of said layers.

9. A switch assembly for an automotive vehicle for touch activation by a vehicle operator of a selected electric circuit from a plurality of electrical circuits, said electrical circuits being employed for operator adjustment of vehicle components for operator function, said switch assembly comprising:

a plurality of switches located in a pattern for individual activation by operator touch, each switch being alternatively connectable for activation of a first electric circuit or for activation of a second electric circuit;

a first layer of sheet material in a fixed position overlying said switches, said first layer sheet material having a lower surface for activating contact with said switches upon operator touch and an upper surface with first layer indicia arranged in said pattern of switches with each element of said first layer indicia identifying for said operator a first electric circuit function of an underlying switch;

a second layer of sheet material adapted to overlie said first layer of sheet material, said second layer of sheet material having a lower surface for activating contact with said switches upon operator touch and an upper surface with second layer indicia also arranged in said pattern with each element of said second layer indicia identifying for said operator a second electric circuit function of an underlying switch, said second layer being supported for lateral movement by said operator from a first position overlying said first layer for second electric circuit activation of said switches to a second position exposing said first layer for first electric circuit activation of said switches by said operator; and an electric circuit activation switch for engagement by said second layer in its first position, said circuit activation switch activating one of said first or second circuits when said second layer is in its first position and then activating the other of said circuits of said switches when said second layer is in its second position out of contact with said circuit activation switch.

10. A switch assembly as recited in claim 9 which is adapted for assembly in an armrest in the operator side door of said vehicle.

11. A switch assembly as recited in claim 9 in which said pattern of switches and said first and second sheet material layers are rectangular in plan view, and said second sheet layer is supported at two opposing side edges for sliding in said support between said first and second positions.

* * * * *